US005425214A

United States Patent [19]

Truelove et al.

[11] Patent Number: 5,425,214

[45] Date of Patent: Jun. 20, 1995

[54] MODULAR FLOOR ASSEMBLY

[75] Inventors: Andrew R. Truelove, Sutton Coldfield; Stephen Crutchley, Walsall; Michael J. Smith, Codsall; Peter Owen, Birmingham, all of Great Britain

[73] Assignee: Expo Floors Limited, Birmingham, United Kingdom

[21] Appl. No.: 2,460

[22] Filed: Jan. 13, 1993

[51] Int. Cl.[6] ..... E04B 5/02

[52] U.S. Cl. ..... 52/762; 52/126.1; 52/126.6; 52/126.7; 52/7; 52/263; 52/780; 52/578

[58] Field of Search ..... 52/126.1, 126.5, 126.6, 52/126.7, 6, 7, 263, 579, 581, 814, 817, 818, 821, 822, 823, 578, 587, 588, 589, 592, 762, 764, 780; 248/650, 677; 5/200.1, 201, 400

[56] References Cited

U.S. PATENT DOCUMENTS

| | | | |
|---|---|---|---|
| 1,636,891 | 7/1927 | Barrows | 52/814 |
| 2,740,167 | 4/1956 | Rowley | 52/589 |
| 2,896,271 | 7/1959 | Kloote et al. | 52/588 X |
| 3,025,934 | 3/1962 | Spiselman et al. | 52/589 X |
| 3,039,575 | 6/1962 | Graham | 52/578 |
| 3,067,843 | 12/1962 | Rushtoh et al. | 52/821 X |
| 3,180,460 | 4/1965 | Liskey | 52/126.6 X |
| 3,279,134 | 10/1966 | Donovan | 52/263 X |
| 3,914,810 | 10/1975 | Harris | 5/200.1 X |
| 4,218,789 | 8/1980 | Grassi | 5/201 |
| 5,048,242 | 9/1991 | Cline | 52/126.6 |

FOREIGN PATENT DOCUMENTS

| | | | |
|---|---|---|---|
| 0498778 | 8/1992 | European Pat. Off. | 52/578 |
| 0047912 | 12/1979 | Germany | 52/126.6 |
| 0218453 | 1/1968 | Sweden | 52/126.6 |
| 0984606 | 2/1965 | United Kingdom | 52/126.6 |
| 1738961 | 6/1992 | U.S.S.R. | 52/578 |

*Primary Examiner*—Carl D. Friedman
*Assistant Examiner*—Robert J. Canfield
*Attorney, Agent, or Firm*—Spensley Horn Jubas & Lubitz

[57] ABSTRACT

A modular floor is constructed from rectangular panels which interlock with one another along their long sides. Each panel is provided with an upwardly-facing surface along one of the longer sides and downwardly-facing surface along the other of its longer sides. The downwardly-facing surface of one panel rests on and is supported by the upwardly-facing surface of an adjacent panel. Each panel may be provided with supporting feet generally below its upwardly-facing surface. The supporting feet, which are preferably detachable from the panels, may be of fixed height or may be adjustable. Two types of adjustable foot are disclosed.

19 Claims, 4 Drawing Sheets

MODULAR FLOOR ASSEMBLY

BACKGROUND TO THE INVENTION

1. Field of the Invention

The present invention relates to modular floor assemblies.

There are various situations where there is a requirement for a floor to be constructed supported upon a permanent foundation such as a concrete floor or even bare ground.

A particular example of such a situation exists where an exhibition is being mounted. Typically, an exhibition hall will have a bare concrete floor but exhibitors wishing to display their goods in a favourable manner typically assemble a temporary floor, generally of wood, on which a carpet or carpet tiles may be laid and supported above the foundation. This has the further advantage of allowing services, such as cables and pipes, to be laid under the floor. Typically, the floor structure is dismantled following the exhibition and its components are re-used.

There is a need to provide components for the modular floor assembly which may be assembled quickly and accurately.

2. Summary of the Prior Art

Modular floor systems are disclosed in French patent specifications Nos. 1424776, 1467295, 1554826, 1557561 and 2236072.

SUMMARY OF THE INVENTION

In a first aspect, the invention provides a floor comprising a plurality of panels, each of said panels having first and second opposite side regions at the first of which is disposed an upwardly-facing surface and at the second of which is disposed a downwardly-facing surface, said downwardly-facing surface overlying and being supported upon said upwardly-facing surface of an adjacent panel.

A floor such as this is strong and is quick and easy to assemble.

In a second aspect, the invention provides a floor comprising a row of panels each of said panels having first and second opposite side regions at the first of which is disposed an upwardly-facing surface and at the second of which is disposed a downwardly-facing horizontal surface; a first sill member having an upwardly-facing surface, the downwardly-facing surface of a first of said panels overlying and being supported by the upwardly-facing surface of the first sill member; a second sill member having an upwardly-facing surface, the downwardly-facing surface of a second of said panels overlying and being supported by the upwardly-facing surface of said second sill member, and an infill panel disposed within the row intermediate said first and second panels said infill panel having a pair of side regions at each of which is disposed a downwardly-facing surface each of which overlies and is supported by said upwardly facing surface of an adjacent one of said panels.

From a third of its aspects, the invention provides a floor comprising a plurality of panels including a panel having first and second opposite side regions the first of said side regions having an upwardly-facing surface and the second of said side regions comprising a downwardly-facing surface, each of said horizontal surfaces being constituted by portions of an elongate metal member.

In a fourth aspect, the invention provides a panel for construction of a floor, a supporting foot comprising an externally screw-threaded shaft, an upper body portion and a lower portion, and attachment means for securing said supporting foot to said panel, each of said upper and lower body portions having a through hole tapped for threaded engagement with said shaft, and said body portions being interconnected by said shaft such that mutual rotation of said body portions causes relative movement between said body portions along said shaft to vary spacing apart of said body portions on said shaft.

A fifth aspect of the invention provides a panel for construction of a floor, a supporting foot comprising a body, attachment means for securing said body to said panel, wherein said body comprises first and second body parts, mutually axially-displacable, and means for manually adjusting the relative positions of said first and second axially-displacable parts.

Other preferred features and advantages associated with the invention will be apparent from the claims and the description.

DETAILED DESCRIPTION OF A PREFERRED EMBODIMENT

Figure 1:
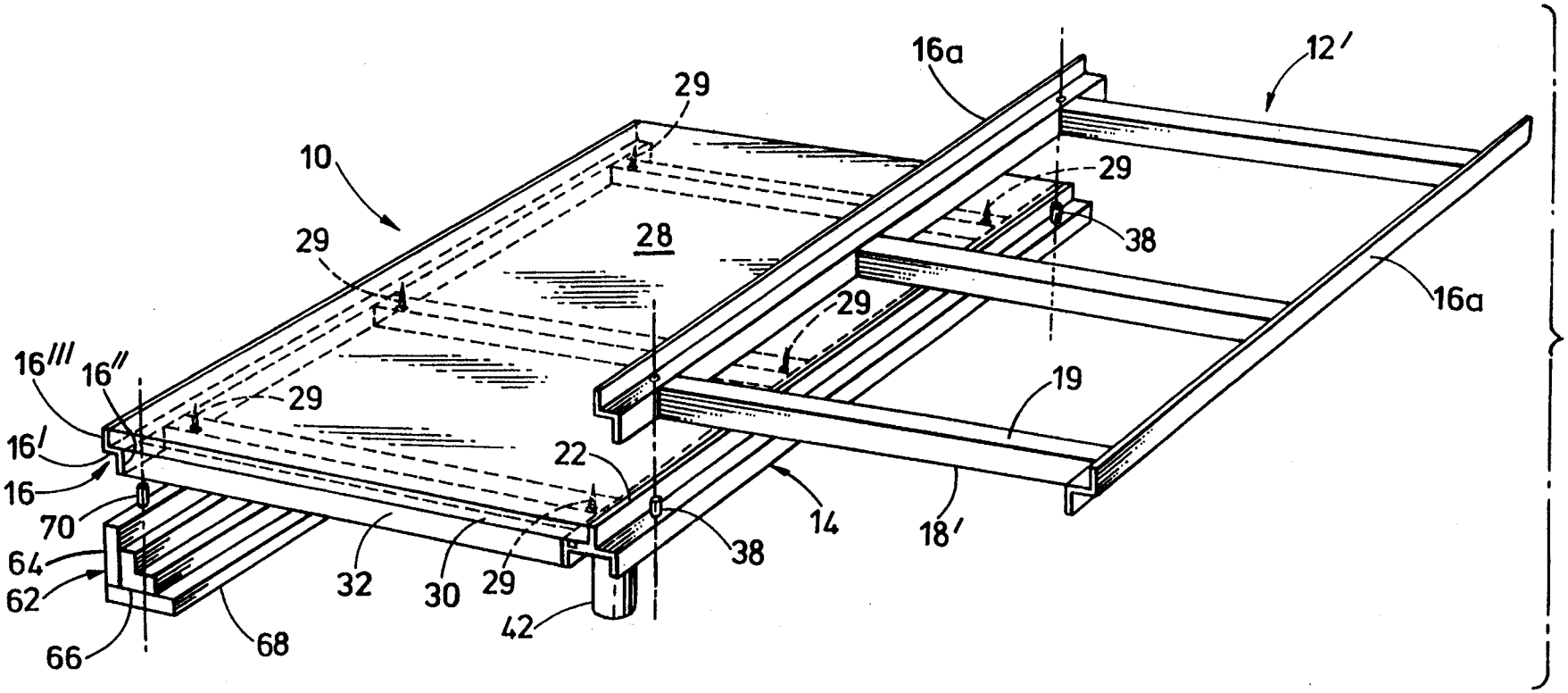
FIG. 1 is an exploded perspective view of a panel and an infill panel which may be interlocked to form a floor embodying the invention.

A modular floor is constructed from a plurality of interlocking panels, one of which is illustrated at 10. In the following description 'up' 'down' and associated terms are to be understood to relate to the installed orientation of the panel, as shown in FIG. 1.

Figure 2:
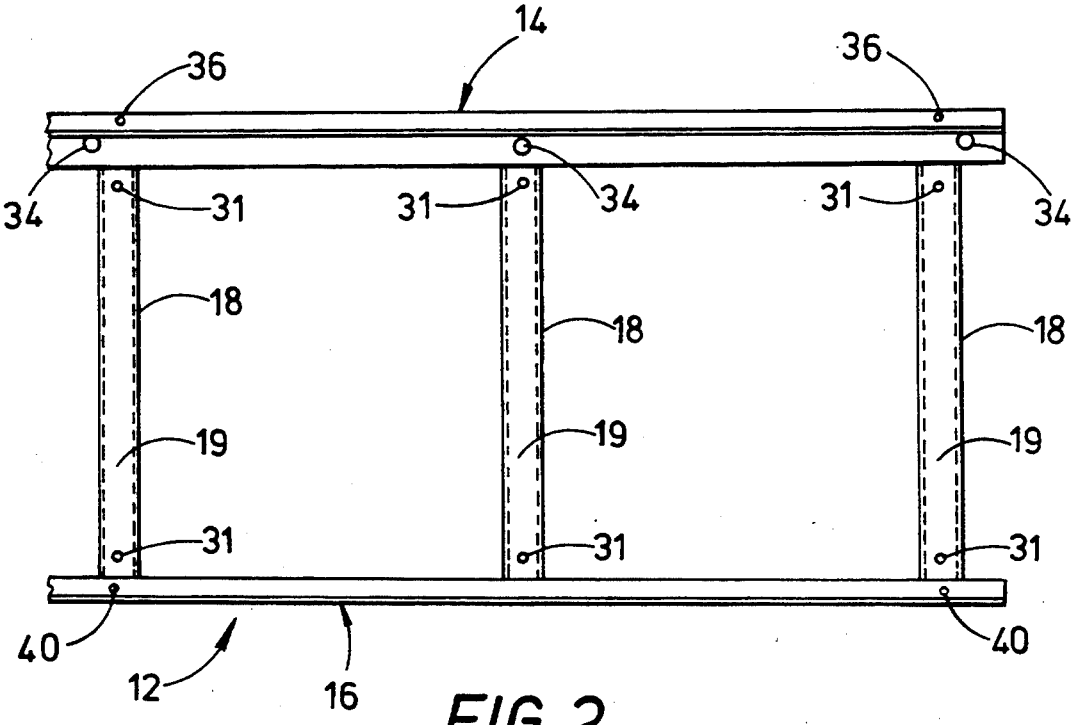
FIGS. 2 and 3 are, respectively, plan and end views of a frame for the panel shown in FIG. 1.
Figure 3:
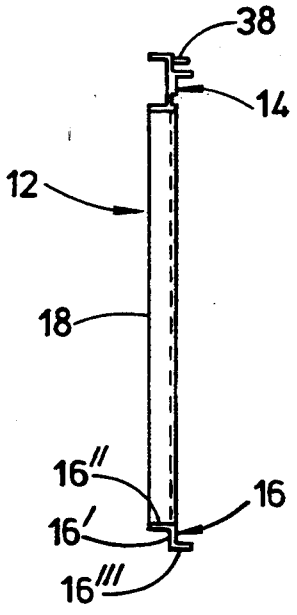

The panel 10 comprises a frame 12 of metal, as shown in FIGS. 2 and 3. The frame has first and second longitudinal members 14, 16 parallel and spaced apart, interconnected by three transverse members 18, one of which is disposed centrally of the longitudinal members 14, 16, the others being disposed close to the ends of the longitudinal members 14, 16. The members 14, 16, 18 are formed as integral aluminium extrusions.

Each transverse member 18 is formed from an inverted, square U-shaped metal extrusion. The transverse members 18 each present a flat, upwardly-directed surface 19 formed by an outer surface of the base portion of the U-shape.

The longitudinal members 14, 16 have uniform cross-section along their lengths but the respective cross-sections of the two members are different. The first longitudinal member 14, shown in detail in FIG. 4, has a cross-section comprising a rectangular U-shaped channel portion 20 which is open downwardly, having a web 20' and opposed inner and outer side limbs 20'',20''' extending down from the web 20'. On the upper surface of the web 20' of the channel portion 20 there is formed a flange 22 upstanding perpendicularly from that upper surface. A thickened section 24 at the upper surface of the web 20' of the channel portion 20 extends to one side of the flange 22 from the base of the flange 22. A rib 26 having a flat upper surface projects upwardly from the channel portion at an edge portion of the web 20' proximal to but spaced from the thickened section 24 of the upper surface of the web, the rib 26 projecting a distance such that its flat upper surface is substantially level with the top of the thickened section 24.

In the assembled frame, the first longitudinal member 14 is disposed such that the thickened section 24 is directed from the flange 22 towards the second longitudinal member 16, end portions of each transverse member 18 being welded to the inner side limb 20" of the first longitudinal member 14.

The second longitudinal member 16 has a cross section comprising integrally connected middle, inner and outer plate portions, 16', 16" and 16"' respectively. The middle plate portion 16' has opposite parallel edge regions, the inner plate portion 16" projecting perpendicularly from one of the edge regions within the frame 12 and the outer plate portion 16"' projecting perpendicularly in the opposite direction from the other edge region. The inner plate portion 16" of the second longitudinal member 16 extends downwardly from the middle plate portion 16' and is secured to respective end portions of each of the transverse members 18. The second longitudinal member is disposed such that its middle plate portion 16' extends horizontally away from the first transverse member 14, substantially coplanar with the upwardly directed surfaces 19 of the transverse members 18. The outer plate portion 16"' thus extends upwardly from the middle plate portion remote from the first longitudinal member 14.

Figure 8:
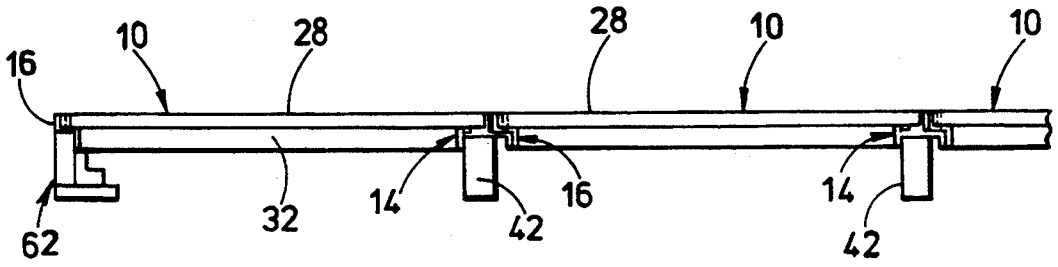
FIG. 8 is an end view of the connected panels of the form shown in FIG. 1.

Together, the upper surface of the middle plate portion 16' of the second longitudinal member 16, the upwardly directed surfaces 19 of the transverse members 18 and the upper surfaces of the rib 26 and thickened section 24 of the first longitudinal member 14 form supporting surfaces for a deck structure 28 of the panel to be described below. The deck structure 28 is prevented from moving in a direction parallel to the transverse members 18 by the flange 22 of the first longitudinal member 14 and by the outer plate portion 16"' of the second longitudinal member 16, both of which extend upwards to the level of the upper surface of the deck structure, as shown in FIGS. 1 and 8.

The deck structure 28 provides a floor surface for the panel 10. It may conveniently be formed from a plywood board 30 being rectangular in shape and dimensioned to be of substantially the same length as the longitudinal members 14, 16 and of width to be a close fit between the flange 22 of the first longitudinal member and the outer plate portion 16"', of the second longitudinal member. A finishing member 32 may be secured to the underside of the board 30 close to each exposed, shorter end face thereof to which material such as carpet may be secured to provide a finished appearance to the end face of the panel where this is visible in use.

The deck structure 28 is secured to the frame by screws 29, which pass through holes 31, formed through the upwardly directed surface 19 of each transverse member 18. Secure fixing may be obtained by providing each transverse member 18 with a pair of screws and corresponding holes disposed close to each of its ends.

Figure 4:
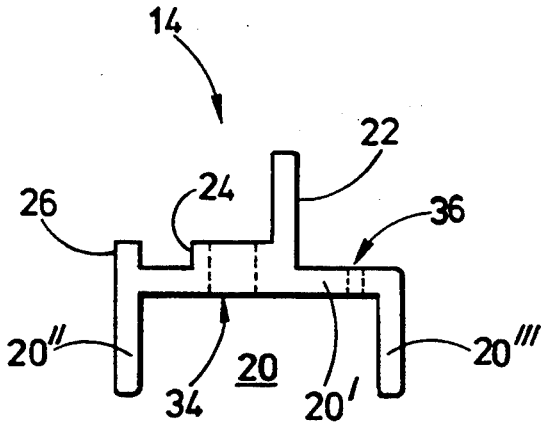
FIG. 4 shows in cross-section a first longitudinal member of the frame of FIGS. 2 and 3.

Tapped holes 34 are provided through the thickened section 24 of the first longitudinal member 14, at least close to each end thereof and preferably also intermediate the two ends thereof, as shown in FIGS. 2 and 4. These holes 34 provide locations for supporting feet to be described below. Further tapped holes 36 are provided through the web 20' of the channel portion 20 to the side of the flange 22 remote from the second longitudinal member 16 and close to the ends of the first longitudinal member 14. Into these holes 36 are screwed pegs 38, FIGS. 1 and 3. Through holes 40, FIG. 2, are provided in the middle plate portion 16' of the second longitudinal member 16 at distances from the ends thereof corresponding to the distances from the ends of the first longitudinal member 14 to the pegs 38. The holes 40 are sufficiently large to allow the pegs 38 to pass therethrough.

Figure 5:
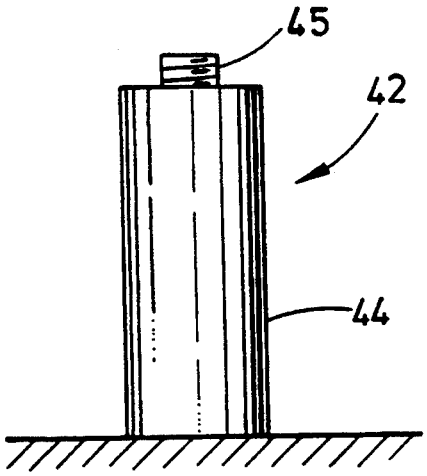
FIGS. 5 and 6 show, respectively, two alternative types of supporting foot for use with the panel of FIG. 1.

Each panel 10 is provided for normal use with at least two supporting feet 42, the most basic type being shown in FIG. 5. Each supporting foot 42 comprises a body portion 44, being an upright solid metal cylinder, and a short length of threaded bar 45 which projects from an upper end face of the body portion. A lower end face of the body portion is flat for engagement with a permanent foundation floor. The threaded bar 45 of each foot 42 is screwed into a corresponding one of the tapped holes 34 in the first longitudinal member 14. One of the feet 42 is provided at least at the tapped hole 34 near each end of the first longitudinal member and, in instances where greater load-bearing strength is required, another is provided at the tapped hole 34 intermediate these two positions.

Figure 6:
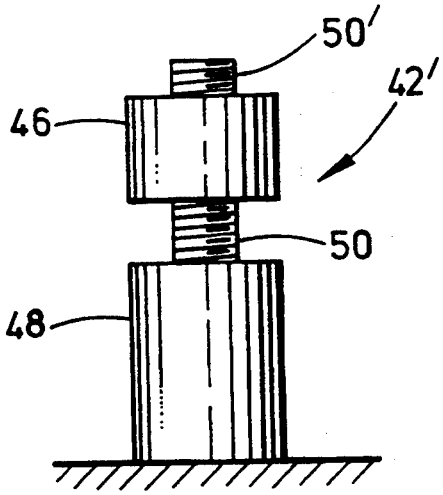

An alternative type of foot is shown in FIG. 6. This foot 42', intended primarily for use in an intermediate position as referred to above, allows for a large amount of un-evenness in a permanent foundation floor to be accommodated. The foot 42' comprises an upper and a lower cylindrical body portion 46, 48 both having an axial tapped through-hole tapped with a thread of diameter and pitch similar to that of the tapped holes 34 in the first longitudinal member 14. A length of threaded bar 50 is screwed into the through-holes of both body portions 46, 48, so interconnecting them. The upper body portion 46 is positioned on the bar 50 such that a short length 50' of the bar 50 projects from an upper end face thereof. The foot 42' is assembled on the panel 10 by screwing the short length 50' of bar 50 into one of the tapped holes 34 in the first longitudinal member 14. The upper body portion 46 is then screwed up the bar 50 until its upper end face abuts the first longitudinal member 14, with the effect of providing a rigid interconnection between the bar 50 and the first longitudinal member 14. During installation the lower body portion 48 is screwed along the bar 50 until its lower end face is at a distance from the first longitudinal member 14 appropriate to engage the foundation floor when the panel 10 is level.

The foot 42' may be used in an alternative configuration in which the upper body portion 46 is screwed up the threaded bar 50 so far that the short length 50' no longer projects but is entirely contained within the upper body portion 46. In this configuration, the foot 42' may be used to support a panel at a position remote from a tapped hole 34, by positioning it below the first longitudinal member 14 or any of the transverse members 18. The height of the foot 42' is adjusted such that its lower body portion 48 engages the permanent foundation floor and an upper end portion of the upper body portion 46 is located within the channel portion 20 of the first longitudinal member 14 or on the underside of the upwardly-directed surface of the transverse member 18, as the case may be. The foot 42' may, in this way, be used to provide localised additional support where required. Furthermore, where a floor is being laid and it is found that a foot 42 secured to a tapped hole 34, as described in the last but one preceding paragraph, coincides with an obstruction, such secured foot 42 may be removed and replaced with a foot 42' in the alternative configuration described above suitably placed to avoid the obstruction.

Figure 7:
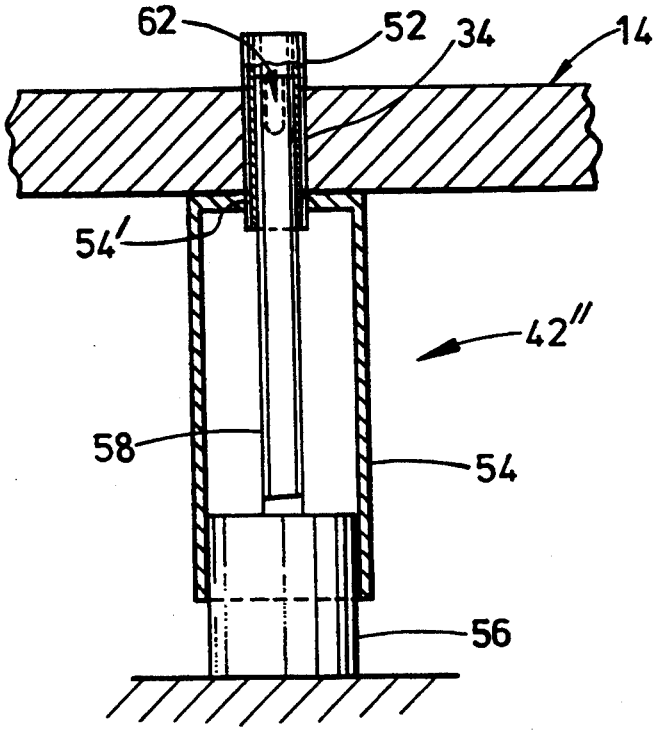
FIG. 7 is a sectional view of a third type of supporting foot for use with the panel of FIG. 1.

A further alternative type of supporting foot 42" is shown in FIG. 7. This supporting foot 42" also allows for adjustment to accommodate un-evenness with the advantage that adjustment may be made after the panel 10 has been laid. The supporting foot has a body comprising an outer sleeve 54 which takes the form of a hollow cylinder having an open and a closed end. A tapped through-hole 54' is formed coaxially with the sleeve 54 through its closed end. A tube 52 with threaded outer surface is screwed into the through-hole 54' and secured there leaving a short portion of the tube projecting from the closed end face of the sleeve 54. The tube 52 is threaded on its outer surface to co-act with the tapping of the through-hole 54' and also has a tapped section within its bore. The supporting foot 42" further comprises a plunger 56, being a solid metal cylinder with an external dimension to be a close sliding fit within the sleeve 54. The plunger 56 has an upper end face to which a threaded shaft 58 is secured at its lower end to project coaxially therewith. An upper end portion of the shaft 58 is screwed into threaded engagement with the tapped section of the bore of the tube 52, so retaining the plunger 56 within the sleeve 54. A hexagonal axial socket 60 is formed in the free upper end face of the shaft 58 into which a tool such as an allen key can be inserted to rotate the shaft 58, such rotation causing axial movement of the shaft 58 and plunger 56 relative to the outer sleeve 54.

The short projecting portion of the tube 52 is screwed into one of the tapped holes 34 in the first longitudinal member 14. A through-hole, not shown, is formed in the deck structure 28 in alignment with the tapped hole 34 to allow a tool to be inserted therethrough for co-operation with the hexagonal socket 60 in the shaft 58. This allows access to the socket 60 for adjustment of the foot 42 after the panel 10 has been laid in a floor and access to its underside is no longer available.

In certain installations the panel 10 may be used without the supporting feet 42. In particular on soft ground, as might be encountered where a floor is to be laid on grass, the panels 10 may instead be supported on lengths of wood running parallel to the transverse members 18 and spaced apart such that they lie close to each end of the longitudinal members 14,16 of the panel 10 and, optionally, intermediately thereof. This has the effect of spreading the load from the panel along the length of wood so reducing the tendency for the panel to sink as the ground beneath it deforms. Alternatively, the supporting feet 42 may be retained, lengths of wood being placed on the ground, the lengths of wood being positioned such that they lie below and provide a firm support for the feet 42.

A sill 62, FIG. 1, is provided for co-operation with the panel 10. The sill 62 comprises an elongate wooden assembly of uniform cross-section. The assembly has an upright member 64 of upright rectangular section and a support member 66 of L-shaped cross-section with parts extending horizontally and vertically. The support member 66 is secured to the upright member such that the horizontal part of its L-shaped section has a lower surface flush with the lower face of the upright member 64, and such that its upright part has an outer surface abutting a vertical surface of the upright member 64. Thus, the upper surface of the upright member 64 together with two upwardly facing surfaces of the support member 66 together form three upwardly-facing surfaces arranged stepwise.

The relative heights of the steps of the sill 62 are chosen such that the uppermost step (the upper surface of the upright member 64) is spaced from the middle step (the uppermost surface of the support merger 66 by a distance equal to the height of the inner plate portion 16" of the second longitudinal member 16. Thus, the sill 62 can support an edge of a panel 10 on the,downwardly-facing surface of the second longitudinal member 14 and on end portions of the transverse members 18.

A wooden block 68 is secured to the lower surface of the sill 62 at each end portion thereof. The wooden block 68 provides a support to space the sill from the permanent foundation, on which it is supported.

A plurality of pegs 70 project upwardly from the upper surface of the upright member 64 of the sill 62. The pegs 70 are of a similar size to, and are spaced apart as are, the pegs 38 on the first longitudinal merger 14. These pegs 70 can thus engage with the holes in the middle plate portion 16' of the second longitudinal member 16.

Also provided is an infill panel which is constructed in a manner closely similar to the panel 10 as described above. The difference in construction lies in that an infill panel has a frame 12', FIG. 1, comprising two longitudinal members **16*a* identical in section to one another and to the second longitudinal member 16 of the panel 10. The frame 12' is symmetrical about a median plane parallel to its longitudinal members 16*a*, the longitudinal members 16*a*** being arranged as mirror-images of one another.

To construct a floor, one or more sills 62 are laid end-to-end to define a first edge of the floor. Onto each sill 62 is laid a panel 10, the pegs 70 of the sill 62 entering the holes in the middle plate portion 16' of the second longitudinal member 16 of the panel 10 to locate the panel 10 on the sill 62. Further panels 10 may be laid each having its second longitudinal member 16 supported on the first longitudinal member 14 of the adjacent panel 10 to form a row of panels 10, as shown in FIG. 8. The pins 38 on the first longitudinal member 14 and holes in the middle plate portion of the second longitudinal member 16 respectively of adjacent panels 10 interengage to lock adjacent panels 10 together. A plurality of rows, one per sill 62, may be laid parallel to and adjacent one another.

Figure 9:
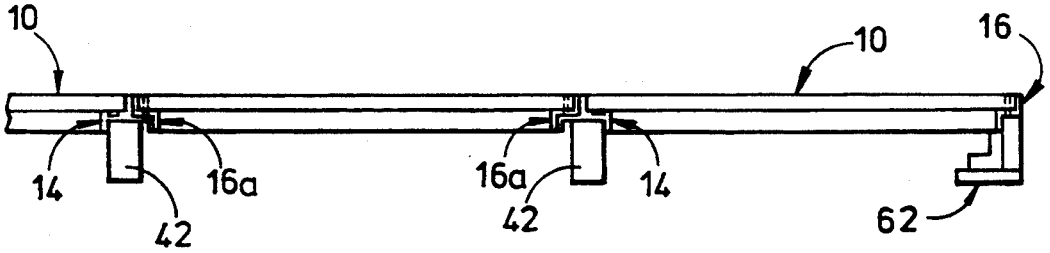
FIG. 9 is an end view of the panels of the form shown in FIG. 1 and an infill panel, also as shown in that Figure, connected together.

Into each row of panels 10, an infill panel is incorporated, as shown in FIG. 9. Each longitudinal member **16*a* of the infill panel is supported upon the first longitudinal member 14 of an adjacently-situated panel 10. It will be appreciated that these adjacently-situated panels 10 must be arranged rotated 180° with respect to one another in order to engage with the infill panel. The row is finished by supporting the free second longitudinal member 16 of the final panel 10 on a sill 62**.

The floor thus provided has a surface the area of which is largely formed by the deck structures 28 of the panels. The only metal elements which are exposed are the thin upper faces of the flanges 22 of the first longitudinal members 14 and of the outer plate portion 16''' of the second longitudinal members 16.

What is claimed is:

1. A floor including a plurality of adjoining interlocking panels, the plurality of panels including a first panel and a second panel adjoining the first panel, each panel of said plurality of panels comprising a rigid frame, a floor surface member supported by said frame, having a planar upper surface and defining a portion of a floor surface, and securing means retaining said floor surface member to said frame, each said frame comprising opposite first and second side members and transverse members extending between and connected to said side members, said side and transverse members having upwardly-facing supporting surfaces lying in a common plane parallel to said upper surface of said floor surface member for supporting said floor surface member, said first and second side members having upstanding portions, which extend alongside said floor surface member to said upper surface and restrain said floor surface member against movement transversely of said side members, said first side member of said frame of at least said first panel having an upwardly-facing surface spaced transversely from said floor surface member and lying in a parallel plane below and parallel to said common plane, said second side member of said frame of at least said second panel having a downwardly-facing surface in said parallel plane, said upwardly-facing surface and said downwardly-facing surface having complementary male and female location formations correspondingly positioned thereat and extending perpendicular thereto, said downwardly-facing surface of said second side member of said frame of said second panel overlying and being supported by said upwardly-facing surface of said first side member of said frame of said first panel and said location formations of said cooperating downwardly-facing and upwardly-facing surfaces being separably interengaged by relative vertical movement for resisting separation of said adjoining panels in a horizontal direction.

2. A floor according to claim 1 in which said first side member of said frame of each of said panels has a said upwardly-facing surface spaced transversely from said floor surface member and lying in a parallel plane below and parallel to said common plane, and said first side member of each said frame has a cross-section comprising a portion of inverted rectangular U-shape, having a web and opposed inner and outer limbs, and a flange upstanding from an intermediate part of said web, said web having inner and outer portions separated by said flange and respectively adjacent to said inner and outer limbs, said inner portion being upwardly thickened and having an upper surface which forms said upwardly-facing supporting surface of said first side member and said outer portion having an upper surface which forms said upwardly-facing surface of said first side member, said second side member of said frame of each of said panels has a said downwardly-facing surface in said parallel plane, and said second side member of each said frame has a cross-section comprising a horizontal middle plate portion having opposite parallel inner and outer edge regions, an inner plate portion projecting downwards from said inner edge region and an outer plate portion projecting upwards from said outer edge region, said middle plate portion having an upper surface and a lower surface which respectively form said upwardly-facing supporting surface and said downwardly-facing surface of said second side member, said flange and said outer plate portion forming said upstanding portions of said first and second side members, and said transverse members being secured to, and extending between, said inner limb of said first side member and said inner plate portion of said second side member.

3. A floor according to claim 1 in which said complementary location formations comprise a hole in said second side member of said frame of said second panel opening through said downwardly-facing surface and a pin projecting from said upwardly-facing surface of said first side member of said frame of said first panel.

4. A floor according to claim 1 in which said frame of each said panel has a plurality of supporting feet releasably engaged therewith which extend downwardly therefrom to provide elevated support for said panel.

5. A floor according to claim 4 in which said supporting feet are engaged with said first side member of said frame at spaced positions therealong.

6. A floor according to claim 5 in which said first side member has tapped holes therein and said feet have externally screw-threaded elements complementary to said tapped holes which screw into said tapped holes to secure said supporting feet releasably to said frame.

7. A floor according to claim 4 in which each said supporting foot is of variable height, comprising a body housing co-axial first and second body parts linearly movable relative to one another to vary the height of said foot and manually adjustable adjustment means interconnecting said first and second body parts for moving said first and second body parts linearly relative to one another.

8. A floor according to claim 7 in which said first body part has a hollow bore into which said second body part extends.

9. A floor according to claim 7 in which each said supporting foot has attachment means for securing said body to said frame comprising a screw-threaded shaft, and said frame has as complementary screw-threaded hole in which said shaft is screwed.

10. A floor according to claim 9 in which said first and second body parts are mutually rotatable, said screw-threaded shaft has a hollow bore tapped with a screw-thread, and said second body part has an externally threaded bar projecting therefrom and screwed into said hollow bore, mutual rotation of said first and second body parts causing relative axial displacement of said shaft and said relative linear movement between said body parts.

11. A floor according to claim 10 in which said threaded bar has an end portion and said adjustment means comprises a formation at said end portion adapted for cooperation with a tool by which said bar may be rotated.

12. A floor according to claim 11 in which an access is provided in said floor surface member for cooperation of said tool with said formation.

13. A floor according to claim 4 in which each said supporting foot is of variable height, comprising an externally screw-threaded shaft, an upper body portion, a lower body portion and attachment means for securing said supporting foot to said frame, each of said upper and lower body portions having a through hole tapped for threaded engagement with said shaft whereby said upper and lower body portions are interconnected, mutual rotation of said upper and lower body portions on said shaft causing relative movement between said body portions along said shaft which variably spaces said body portions apart on said shaft.

14. A floor according to claim 13 in which said attachment means comprises a length of said shaft projecting from said upper body portion, and said frame has a complementary screw-threaded hole in which said projecting length of said shaft is screwed.

15. A floor according to claim 1 which further comprises a sill having an upwardly-directed surface and wherein one of said side members of said frame of at least one of said panels has a downwardly-directed surface overlying and being supported by said upwardly-directed surface of said sill.

16. A floor according to claim 1 in which said side and transverse members of each said frame are metal extrusions and each said floor surface member is formed of plywood board.

17. A floor including a plurality of interlocking panels, the plurality of panels including first and second panels and an infill panel located between, and adjoining each of, the first and second panels, each said panel comprising a rigid frame, a floor surface member supported by said frame having a planar upper surface and defining a portion of a floor surface, and securing means retaining said floor surface member to said frame, each said frame comprising opposite side members and transverse members extending between and connected to said side members, said side and transverse members having upwardly-facing supporting surfaces lying in a common plane parallel to said upper surface of said floor surface member for supporting said floor surface member, and said side members having upstanding portions which extend along side said floor surface member to said upper surface and restrain said floor surface member against movement transversely of said side members, said frames of said first and second panels each having a first one of said side members adjacent to said infill panel and a second one of said side members remote therefrom, said first side member having an upwardly-facing surface spaced transversely from said floor surface member and lying in a parallel plane below and parallel to said common plane, and said side members of said frame of said infill panel, each having a downwardly-facing surface in said parallel plane, said upwardly-facing surfaces of said first side members of said first and second panels and said downwardly facing surfaces of said side members of said infill panel having complementary male and female location formations correspondingly positioned thereat and extending perpendicular thereto, said downwardly-facing surfaces overlying and being supported by said upwardly-facing surfaces, and said location formations of said cooperating downwardly-facing and upwardly-facing surfaces being separably inter-engaged by relative vertical movement for resisting separation of said infill panel from said first and second panels in a horizontal direction.

18. A floor panel comprising a rigid frame, a floor surface member supported by said frame, having a planar upper surface and defining a portion of a floor surface, and securing means retaining said floor surface member to said frame, said frame comprising opposite first and second side members and transverse members extending between and connected to said side members, said side and transverse members having upwardly-facing supporting surfaces lying in a common plane parallel to said upper surface of said floor surface member for supporting said floor surface member, said first and second side members having upstanding portions which extend alongside said floor surface member to said upper surface and restrain said floor surface members against movement transversely of said side members, said first side member having an upwardly-facing surface spaced transversely from said floor surface member and lying in a parallel plane below and parallel to said common plane, said second side member having a downwardly-facing surface in said parallel plane, and said upwardly-facing surface and said downwardly-facing surface having complementary male and female location formations correspondingly positioned thereat and extending perpendicular thereto.

19. A floor panel comprising a rigid frame, a floor surface member supported by said frame, having a planar upper surface and defining a portion of a floor surface, and securing means retaining said floor surface member to said frame, said frame comprising opposite side members and transverse members extending between and connected to said side members, said side and transverse members having upwardly-facing supporting surfaces lying in a common plane for supporting said floor surface member, said side members having upstanding portions which extend alongside said floor surface member to said upper surface and restrain said floor surface member against movement transversely of said side members, and each said side member having a downwardly-facing surface below said supporting surface lying in a parallel plane below and parallel to said common plane, and said downwardly-facing surfaces having like location formations thereat extending perpendicular thereto.

* * * * *